US008946557B2

(12) United States Patent
Fukuda et al.

(10) Patent No.: US 8,946,557 B2
(45) Date of Patent: Feb. 3, 2015

(54) MULTILAYER INSULATED ELECTRIC WIRE AND TRANSFORMER USING THE SAME

(75) Inventors: Hideo Fukuda, Tokyo (JP); Yohei Ishii, Tokyo (JP); Daisuke Muto, Tokyo (JP); Hiroyuki Egawa, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 13/409,869

(22) Filed: Mar. 1, 2012

(65) Prior Publication Data

US 2012/0154099 A1 Jun. 21, 2012

Related U.S. Application Data

(63) Continuation of application No. PCT/JP2010/064840, filed on Aug. 31, 2010.

(30) Foreign Application Priority Data

Sep. 2, 2009 (JP) ..... 2009-203148

(51) Int. Cl.

| | |
|---|---|
| ***H01B 7/00*** | (2006.01) |
| ***H01B 3/30*** | (2006.01) |
| ***H01B 3/42*** | (2006.01) |
| *H01F 27/28* | (2006.01) |

(52) U.S. Cl.

CPC ..... *H01B 3/301* (2013.01); *H01B 3/305* (2013.01); *H01B 3/423* (2013.01); *H01F 27/2823* (2013.01)

USPC ..... 174/110 R; 174/110 AR; 174/110 SR; 174/120 R; 174/121 R; 174/36

(58) Field of Classification Search

USPC ..... 174/36, 110–110 N, 113 R, 120 R, 174/120 SR, 126.1, 126.2

See application file for complete search history.

(56) References Cited

U.S. PATENT DOCUMENTS 5,358,786 A * 10/1994 Ishikawa et al. ..... 428/380
5,426,264 A * 6/1995 Livingston et al. ..... 174/102 R
5,492,761 A * 2/1996 Shukushima ..... 428/379

(Continued)

FOREIGN PATENT DOCUMENTS

JP 3-56112 U 5/1991
JP 6-223634 A 8/1994

(Continued)

OTHER PUBLICATIONS

International Search Report for PCT/JP2010/064840 dated Dec. 7, 2010.

(Continued)

*Primary Examiner* — William H Mayo, III
(74) *Attorney, Agent, or Firm* — Birch, Stewart, Kolasch & Birch, LLP

(57) ABSTRACT

A multilayer insulated electric wire having: a conductor; at least three extruded insulating layers covering the conductor; wherein an outermost layer (A) of the insulating layers is composed of an extruded coating layer containing a polyamide resin and the film thickness is 25 μm or less, wherein an inner layer (B) of the extruded insulating layers is composed of an extruded coating layer containing a crystalline resin having a melting point of 225° C. or more or an amorphous resin having a glass transition temperature of 200° C. or more.

4 Claims, 2 Drawing Sheets

(56) References Cited

U.S. PATENT DOCUMENTS

| | | | | | |
|---|---|---|---|---|---|
| 5,606,152 | A | * | 2/1997 | Higashiura et al. | 174/120 R |
| 5,965,263 | A | * | 10/1999 | Tatematsu et al. | 428/383 |
| 6,359,230 | B1 | * | 3/2002 | Hildreth | 174/110 R |
| 7,087,843 | B2 | * | 8/2006 | Ishii et al. | 174/110 R |
| 2008/0187759 | A1 | | 8/2008 | Fukuda et al. | |

FOREIGN PATENT DOCUMENTS

| | | | | | |
|---|---|---|---|---|---|
| JP | 10-134642 | A | | 5/1998 | |
| JP | 2005-203334 | A | * | 7/2005 | H01B 7/02 |
| JP | WO 2007/037417 | A | * | 4/2007 | H01B 7/02 |
| JP | 2008-198445 | | * | 8/2008 | H01B 7/02 |
| JP | 2008-198445 | A | | 8/2008 | |
| JP | 2008-243738 | A | | 10/2008 | |
| WO | WO 2007/037417 | A1 | | 4/2007 | |

OTHER PUBLICATIONS

An Extended European Search Report, dated May 31, 2013, for Patent Application No. 10813697.9.

* cited by examiner

-PRIOR ART-

MULTILAYER INSULATED ELECTRIC WIRE AND TRANSFORMER USING THE SAME

CROSS REFERENCE TO RELATED APPLICATION

This application is a continuation of PCT/JP2010/064840 filed on Aug. 31, 2010, which claims priority of patent application Ser. No. 2009-203148 filed in Japan on Sep. 2, 2009, all of which are hereby expressly incorporated by reference into the present application.

TECHNICAL FIELD

The present invention relates to a multilayer insulated electric wire having an insulating layer composed of three or more extruded layers, and a transformer using the same.

BACKGROUND ART

The construction of a transformer is prescribed by IEC (International Electrotechnical Communication) standards Pub. 60950, etc. Namely, these standards provide that at least three insulating layers be formed between primary and secondary windings (an enamel film which covers a conductor of a winding is not authorized as an insulating layer) or that the thickness of an insulating layer be 0.4 mm or more. The standards also provide that the creepage distance between the primary and secondary windings, which varies depending on applied voltage, be 5 mm or more, that the transformer withstands a voltage of 3,000 V, applied between the primary and secondary sides, for one minute or more, and the like.

According to such standards, as a currently prevailing transformer, a construction illustrated in a cross-section view of FIG. 2 has been adopted. Referring to FIG. 2, an enameled primary winding 4 is wound around a bobbin 2 on a ferrite core 1 in a manner such that insulating barriers 3 for securing the creepage distance are arranged individually on the opposite sides of the peripheral surface of the bobbin 2. An insulating tape 5 is wound for at least three turns on the primary winding 4, additional insulating barriers 3 for securing the creepage distance are arranged on the insulating tape, and an enameled secondary winding 6 is then wound around the insulating tape.

In recent years, however, a transformer having a structure that includes neither an insulating barrier 3 nor an insulating tape layer 5, as shown in FIG. 1, has been used instead of the transformer having the sectional structure shown in FIG. 2. The transformer shown in FIG. 1 has advantages in that the overall size thereof can be reduced compared to the transformer having the structure shown in FIG. 2 and that an operation of winding the insulating tape can be omitted.

In manufacturing the transformer shown in FIG. 1, it is necessary, in consideration of the aforesaid IEC standards, that at least three insulating layers 4*b* (6*b*), 4*c* (6*c*), and 4*d* (6*d*) are formed on the outer peripheral surface on one or both of conductors 4*a* (6*a*) of the primary winding 4 and the secondary winding 6.

As such a winding, there is known a structure in which an insulating tape is first wound around a conductor to form a first insulating layer thereon, and is further wound to form second and third insulating layers in succession, so as to form three insulating layers that are separable from one another. In addition, there is known a winding structure in which fluororesin in place of an insulating tape is successively extrusion-coated around a conductor to form three insulating layers in all (see, for example, Patent Literature 1).

In the above-mentioned case of producing a twisted wiring for an insulating tape, however, because winding the tape is an unavoidable operation, the efficiency of production is extremely low, and thus the cost of the electrical wire is conspicuously increased.

In addition, in the case of extruding fluororesin and coating insulated electric wires, there is an advantage in that the insulating layers have good heat resistance, because they are formed of fluororesin. However, there are problems in that, because of the high cost of the fluororesin and the property that when it is pulled at a high shearing speed, the external appearance is deteriorated, it is difficult to increase the production speed, and the cost of the insulated electric wire coated by extruding fluororesin is increased as in the case of winding the insulating tape.

In attempts to solve such problems, a multilayer insulated electric wire is put to practical use and is manufactured by extruding a modified polyester resin, the crystallization of which has been controlled to inhibit a decrease in the molecular weight thereof, around a conductor to form first and second insulating layers, and polyamide resin extruded around the second insulating layer to form a third insulating layer (see, for example, Patent Literatures 2 and 3). In association with recent miniaturization of electrical or electronic equipment, an influence of heat generation on the equipment has been concerned, so a multilayer insulated wire with improved heat resistance has been proposed, which is obtained by extruding a polyethersulfone resin as an inner layer and a polyamide resin as an outermost layer to cover the outer periphery of a conductor (see, for example, Patent Literature 4).

The above-described electric insulated wire has been developed for the application of electric or electronic devices in accordance with IEC (International Electrotechnical Communication) standards Pub. 60950. It is desired that the insulated electric wire which can realize downsizing and high efficiency is developed for the application of home electronics in accordance with IEC standards Pub. 61558. Therefore, there is a need for a multilayer insulated electric wire in accordance with IEC standards Pub. 61558 which require strict voltage regulation.

CITATION LIST

Patent Literatures

Patent Literature 1: JU-A-3-56112 ("JU-A" means unexamined published Japanese utility model registration application)

Patent Literature 2: U.S. Pat. No. 5,606,152

Patent Literature 3: JP-A-6-223634 ("JP-A" means unexamined published Japanese patent application)

Patent Literature 4: JP-A-10-134642

SUMMARY OF INVENTION

Technical Problem

The present invention contemplated for providing a multilayer insulated electric wire for satisfying IEC standards Pub. 61558 which require strict voltage regulation as described above. Further, the present invention contemplated for providing a highly reliable transformer formed by winding the insulated electric wire having excellent voltage resistance characteristics.

According to the present invention, there is provided the following means:

(1) A multilayer insulated electric wire comprising: a conductor; and at least three extruded insulating layers covering the conductor; wherein an outermost layer (A) of the insulating layers is composed of an extruded coating layer containing a polyamide resin and a thickness of the layer is 25 μm or less, and wherein an inner layer (B) of the extruded insulating layers is composed of an extruded coating layer containing a crystalline resin having a melting point of 225° C. or more or an amorphous resin having a glass transition temperature of 200° C. or more;

(2) The multilayer insulated electric wire according to (1), wherein a resin to form the inner layer (B) of the insulating layers contains a thermoplastic linear polyester resin of the crystalline resin having a melting point of 225° C. or more;

(3) The multilayer insulated electric wire according to (1) or (2), wherein a resin to form the inner layer (B) of the insulating layers contains a resin mixture, which comprises 100 parts by mass of the thermoplastic linear polyester resin of the crystalline resin having a melting point of 225° C. or more, and 5 to 40 parts by mass of an ethylene-based copolymer, wherein the ethylene-based copolymer has a carboxylic acid side chain or a metal carboxylate side chain;

(4) The multilayer insulated electric wire according to (1) or (2), wherein a resin to form the inner layer (B) of the insulating layers contains a resin mixture prepared by mixing 1 to 20 parts by mass of an epoxy group-containing resin based on 100 parts by mass of the thermoplastic linear polyester resin of the crystalline resin having a melting point of 225° C. or more;

(5) The multilayer insulated electric wire according to (1), wherein a base resin component to form the inner layer (B) of the insulating layer is comprised of 75 to 95% by mass of a polyester-based resin of the crystalline resin having a melting point 225° C. or more, except a liquid crystal polymer, and 5 to 25% by mass of a polyester-based resin of a liquid crystal polymer having a melting point of 225° C. or more;

(6) The multilayer insulated electric wire according to (5), wherein a resin for forming the inner layer (B) of the insulating layers contains 1 to 20 parts by mass of an epoxy group-containing resin based on 100 parts by mass of the base resin component;

(7) The multilayer insulated electric wire according to (1), wherein a resin for forming the inner layer (B) of the insulating layers contains a polyphenylene sulfide resin of the crystalline resin having a melting point of 225° C. or more;

(8) The multilayer insulated electric wire according to (1), wherein a resin for forming the inner layer (B) of the insulating layers contains a polyether sulfone resin of an amorphous resin having a glass transition temperature of 200° C. or more;

(9) The multilayer insulated electric wire according to (1), wherein a resin for forming an inner layer (B1) which is in contact with the outermost layer (A) of the insulating layer is a polyphenylene sulfide resin of the crystalline resin having a melting point of 225° C. or more, and wherein at least one layer of inner layers (B2) other than the inner layer (B1) contains 1 to 20 parts by mass of an epoxy group-containing resin based on 100 parts by mass of a thermoplastic linear polyester resin of the crystalline resin having a melting point of 225° C. or more; and

(10) A transformer, employing the multilayer insulated electric wire as described in any one of the above items (1) to (9).

Solution to Problem

The present invention contemplates for achieving by a multilayer insulated electric wire and a transformer using the same to be described hereinafter.

Advantageous Effects of Invention

The multilayer insulated electric wire of the present invention has voltage resistance characteristics for satisfying IEC standards Pub. 61558 to be required as home electronics while holding the heat resistance level higher than the class B. The heat resistance level higher than the class B means a level that "ten turns of the multilayer insulated electric wires are wound around a mandrel with a diameter of 10 mm under a load of 9.4 kg. Three cycles of heating the electric wires at 225° C. for 1 hour and heating them at 150° C. for 21 hours are performed, and then they are kept in an atmosphere of 30° C. and humidity 95% for 48 hours. Thereafter, a voltage of 5,500 V is applied thereto for 1 minute and there is no electrical short-circuit" in a test method in accordance with IEC standards Pub. 61558. In the multilayer insulated electric wire of the present invention, when a polyamide resin as the outermost layer of the insulating layer is used in combination with a resin excellent in extension characteristics and heat resistance, which is required as the electric wire, as the inner layer, required points such as flexibility and chemical resistance can be satisfied. Particularly, when the polyamide resin is used for the outermost layer, if the film thickness is made thin to some extent, voltage resistance characteristics are further increased. Thus, the diameter of the insulated electric wire can be made smaller.

The multilayer insulated electric wire of the present invention can be directly subjected to soldering at the time of terminal processing, so that the operability of the winding processing is sufficiently improved. The transformer of the present invention formed by using the multilayer insulated electric wire is excellent in electric characteristics at high voltages and during heating at high temperatures and has high reliability.

Other and further features and advantages of the invention will appear more fully from the following description, appropriately referring to the accompanying drawings.

DESCRIPTION OF EMBODIMENTS

Figure 1:
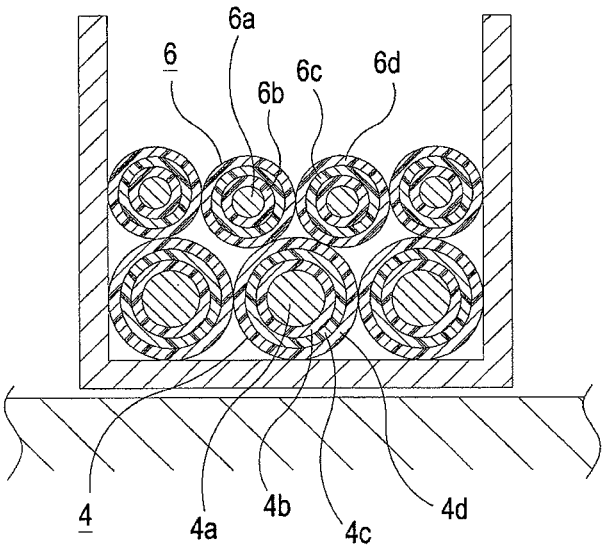
FIG. 1 is a cross-sectional view showing an example of a transformer having a structure in which a multilayer insulated electric wire is used as a winding.
Figure 2:
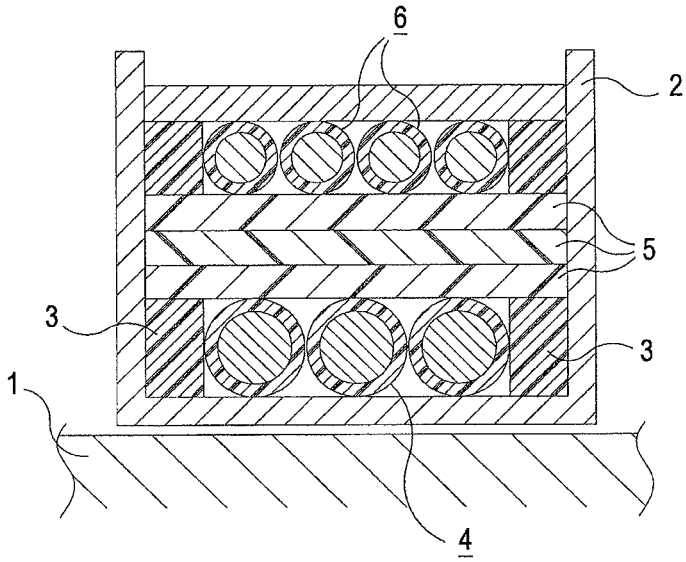
FIG. 2 is a cross-sectional view showing one example of a transformer having a conventional structure.

Although the insulated electric wire has been used in the field of electric or electronic devices, there is a demand for the multilayer insulated electric wire in the field of home electronics in which a higher level of voltage resistance is required. However, in conventional multilayer insulated electric wires, there has been no insulated electric wire which satisfies IEC standards Pub. 61558.

As for the multilayer insulated electric wire of the present invention, the insulating layers to be covered is composed of at least three layers, preferably three layers. As for one preferred embodiment of a multilayer insulated electric wire of the present invention, resins for constituting each layer will be described.

The outermost layer (A) of the multilayer insulated electric wire of the present invention is an extruded coating layer including a polyamide resin. Examples of polyamide resins suitable for use in the outermost insulation layer include nylon 6,6 (such as A-125 (trade name) manufactured by Unitika Ltd. and Amilan CM-3001 (trade name) manufactured by Toray Industries, Ltd.), nylon 4,6 (such as F-5000 (trade name) manufactured by Unitika Ltd. and C2000 (trade name) manufactured by Teijin Limited.), nylon 6,T (Arlen AE-420 (trade name) manufactured by Mitsui Chemicals, Inc.), and polyphthalamide (Amodel PXM 04049 (trade name) manufactured by Solvay S. A.).

Even if the film thickness of the extruded coating layer in the outermost layer (A) composed of the polyamide resin is thinner, voltage resistance characteristics become good. Thus, it can be set to 25 μm or less, preferably from 10 to 20 μm. If the film thickness is too thin, the heat resistance is reduced. If the film thickness is too thick, voltage resistance characteristics are reduced.

The inner layer (B) of the multilayer insulated electric wire of the present invention is formed of an extruded coating layer containing a crystalline resin having a melting point of 225° C. or more, preferably 250° C. or more. If the melting point is too low, the heat resistance is insufficient and does not satisfy the class B, which is not unsuitable as the coating layer.

Examples of the crystalline resin having a melting point of 225° C. or more include a polyethylene terephthalate resin, a polybutylene terephthalate resin, and polybutylene naphthalate. Particularly, the polyethylene terephthalate resin which is the thermoplastic linear polyester resin to be described later is preferred.

The inner layer (B) of the multilayer insulated electric wire of the present invention may be formed of an extruded coating layer containing an amorphous resin having a glass transition temperature of 200° C. or more, preferably 220° C. or more. If the glass transition temperature of the amorphous resin is too low, the heat resistance is insufficient and does not satisfy the class B, which is not unsuitable as the coating layer.

Examples of the amorphous resin include a polysulfone resin, a polyether sulfone resin, and a polyetherimide resin. The polyether sulfone resin of the amorphous resin to be described later is preferred.

In the preferred embodiment of the present invention, the inner layer (B) of the insulating layers which is formed of a crystalline resin having a melting point of 225° C. or more is an extrusion-coating layer including the thermoplastic linear polyester resin which is partially or entirely formed by combining an aliphatic alcohol component and an acid component.

The thermoplastic linear polyester resin is preferably a resin obtained by esterification of either aromatic dicarboxylic acid or dicarboxylic acid, part of which is substituted with an aliphatic dicarboxylic acid, with an aliphatic diol. Typical examples thereof may include polyethylene terephthalate resins (PET), polybutylene terephthalate resins (PBT), polyethylene naphthalate resins (PEN) and the like.

Examples of the aromatic dicarboxylic acid used in the synthesis of the thermoplastic linear polyester resin include terephthalic acid, isophthalic acid, terephthalic dicarboxylic acid, diphenylsulfonedicarboxylic acid, diphenoxyethanedicarboxylic acid, diphenylethercarboxylic acid, methylterephthalic acid, methylisophthalic acid and the like. Among them, terephthalic acid is particularly preferred.

Examples of the aliphatic dicarboxylic acid for substituting a part of the aromatic dicarboxylic acid include succinic acid, adipic acid, sebacic acid and the like. The substitution amount of the aliphatic dicarboxylic acid is preferably less than 30 mole %, and particularly preferably less than 20 mole %, based on the aromatic dicarboxylic acid.

Meanwhile, examples of the aliphatic diol used in the esterification include ethylene glycol, trimethylene glycol, tetramethylene glycol, hexanediol, decanediol and the like. Among them, ethylene glycol and tetramethyl glycol are preferred. The aliphatic diol may also be partially replaced with oxyglycol such as polyethylene glycol and polytetramethylene glycol.

Examples of the commercially available thermoplastic linear polyester resin preferably used in the present invention include polyethylene terephthalate (PET) such as "VYLOPET" (trade name, manufactured by Toyobo Co., Ltd.), "Bellpet" (trade name, manufactured by Kanebo, Ltd.), and "Teijin PET" (trade name, manufactured by Teijin Ltd.); polyethylene naphthalate (PEN) resins such as "Teijin PEN" (trade name, manufactured by Teijin Ltd.); and polycyclohexanedimethylene terephthalate (PCT) resins such as EKTAR (trade name, manufactured by Toray Industries, Inc.).

Furthermore, a resin to form the inner layer (B) of the insulating layers preferable contains a resin mixture prepared by mixing 5 to 40 parts by mass of an ethylene-based copolymer having a carboxylic acid side chain or a metal carboxylate side chain based on 100 parts by mass of the thermoplastic linear polyester resin of the crystalline resin having a melting point of 225° C. or more The resin mixture preferably contains an ethylene-based copolymer having a carboxylic acid or metal carboxylate side chain linked to the polyethylene. The ethylene-based copolymer serves to inhibit crystallization of the thermoplastic linear polyester resin.

Examples of the carboxylic acid to be linked to an ethylene-based copolymer include unsaturated monocarboxylic acids such as acrylic acid, methacrylic acid and crotonic acid; and unsaturated dicarboxylic acids such as maleic acid, fumaric acid and phthalic acid. Examples of the metal salt thereof include Zn salts, Na salts, K salts, and Mg salts.

Examples of the ethylene-based copolymer include ethylene-methacrylic acid copolymers with the carboxylic acid group partially replaced with a metal salt group (generally called ionomer resin, such as HIMILAN (trade name) manufactured by Mitsui Polychemical Co., Ltd.), ethylene-acrylic acid copolymers (such as EAA (trade name) manufactured by The Dow Chemical Company), and ethylene graft copolymers having carboxylic acid side chains (such as ADMER (trade name) produced by Mitsui Chemicals, Inc.).

In this embodiment, the resin mixture for forming the inner layer (B) preferably includes 100 parts by mass of the thermoplastic linear polyester resin and 5 to 40 parts by mass of the ethylene-based copolymer having a carboxylic acid side chain or a metal carboxylate side chain. If the content of the latter is too low, it can be less effective in inhibiting crystallization of the thermoplastic linear polyester resin so that so-called crazing may occur in which microcracks are formed in the surface of the insulation layer during a coiling process or any other bending process, although the insulation layer formed has no problem of heat resistance. If the content of the latter is too low, degradation of the insulation layer could also proceed with time to cause a significant reduction in dielectric breakdown voltage. If the content of the latter is too high, the heat resistance of the insulation layer could be significantly degraded. The mixing ratio of the former to the latter is preferably 100 parts by mass: 7 to 25 parts by mass.

In another preferred embodiment of the present invention, the inner layer (B) is an extruded coating layer including a mixture of 100 parts by mass of a thermoplastic linear polyester resin having a melting point of 225° C. or more and 1 to 20 parts by mass of a resin having an epoxy group, wherein the thermoplastic linear polyester resin is partially or entirely formed by combining an aliphatic alcohol component and an acid component. The thermoplastic linear polyester resin may be the same as in the above embodiment and may also have the same preferred range. The epoxy group is a functional group which is reactive with the thermoplastic linear polyester resin. The epoxy group-containing resin preferably includes 1 to 20% by mass of, more preferably 2 to 15% by mass of a monomer unit having the functional group. Such a resin is preferably a copolymer including an epoxy group-containing compound unit. For example, such a reactive epoxy group-containing compound may be an unsaturated carboxylic acid glycidyl ester compound represented by Formula (1):

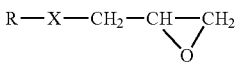

Formula (1)

[In formula (1), R represents an alkenyl group having 2 to 18 carbon atoms; and X represents a carbonyloxy group.]

Specific examples of the glycidy ester of an unsuturated calboxylic acid include glycidyl acrylate, glycidyl methacrylate, and glycidyl itaconate. Among them, glycidyl methacrylate is preferable.

Typical examples of the epoxy group-containing resins that have reactivity with the thermoplastic linear polyester resin may include an ethylene/glycidylmethacrylate copolymer, an ethylene/glycidylmethacrylate/methylacrylate terpolymer, an ethylene/glycidylmethacrylate/vinylacetate terpolymer, an ethylene/glycidylmethacrylate/methylacrylate/vinylacetate tetrapolymer, and the like. Among them, the ethylene/glycidylmethacrylate copolymer and the ethylene/glycidylmethacrylate/methylacrylate terpolymer are preferred. Examples of commercially available resin may include Bondfast (trade name, manufactured by Sumitomo Chemical Co., Ltd.) and LOTADER (trade name, manufactured by ATOFINA Chemicals, Inc.).

In this embodiment, the resin mixture for forming the inner layer (B) preferably includes 100 parts by mass of the thermoplastic linear polyester resin and 1 to 20 parts by mass of the epoxy group-containing resin. If the content of the latter is too low, it can be less effective in inhibiting crystallization of the thermoplastic linear polyester resin so that so-called crazing may occur in which microcracks are formed in the surface of the insulation layer during a coiling process or any other bending process. If the content of the latter is too low, degradation of the insulation layer could also proceed with time to cause a significant reduction in dielectric breakdown voltage. If the content of the latter is excessive, the heat resistance of the insulating layers is significantly reduced. This does not satisfy the class B. The mixing ratio of the former to the latter is preferably 100 parts by mass: 2 to 15 parts by mass. In the present invention, the time degradation and the embrittlement of the resin are suppressed by reaction of a carboxyl group and an epoxy group in the thermoplastic linear polyester resin, and thus a multilayer insulated electric wire excellent in flexibility can be obtained.

The base resin component constituting the inner layer (B) of another embodiment is a polyester-based resin composition comprising a polyester-based resin which contains 75 to 95% by mass of a polyester-based resin which is a crystalline resin having a melting point of 225° C. or more, except the liquid crystal polymer, and 5 to 25% by mass of a polyester-based resin of a liquid crystal polymer having a melting point of 225° C. or more. As the method of mixing the polyester-based resin other than the liquid crystal polymer with the liquid crystal polymer, arbitrary methods can be used.

The liquid crystal polymer for use in the present invention is described below.

The molecular structure, density, molecular weight and like of the liquid crystal polymer that is used for the present invention is not particularly limited, and a melt liquid-crystal type polymer (thermotropic liquid crystal polymer) which forms a liquid crystal when melted is preferred. The melt liquid-crystal type polymer is preferably a melt liquid-crystal type polyester copolymer.

Examples of such melt liquid-crystal type polyesters include: (I) copolymerized polyesters which are obtained by block copolymerization of two kinds of rigid linear polyesters having a different chain length; (II) polyesters introduced with a non-linear structure, which are obtained by block copolymerization of a rigid linear polyester with a rigid non-linear polyester; (Ill) polyesters introduced with a flexible chain, which are obtained by copolymerization of a rigid linear polyester with a flexible polyester; and (IV) nucleus-substituted aromatic polyesters which are obtained by introducing a substituent on the aromatic ring of rigid linear polyesters.

Examples of repeating units of such polyesters include, but are not limited to, "a. those derived from aromatic dicarboxylic acids", "b. those derived from aromatic diols", and "c. aromatic hydroxycarboxylic acids".

a. Repeating units derived from aromatic dicarboxylic acids:

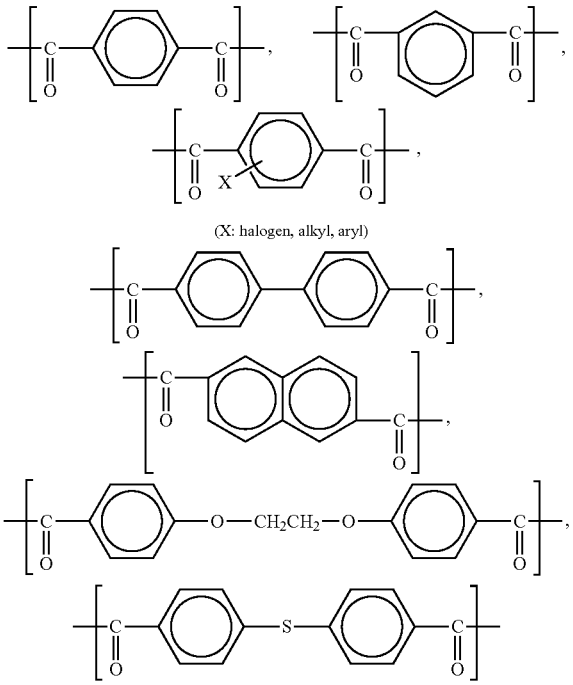

(X: halogen, alkyl, aryl)

b. Repeating units derived from aromatic diols:

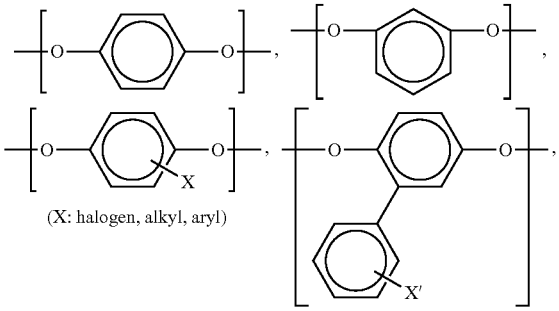

(X: halogen, alkyl, aryl)

(X′: halogen, alkyl)

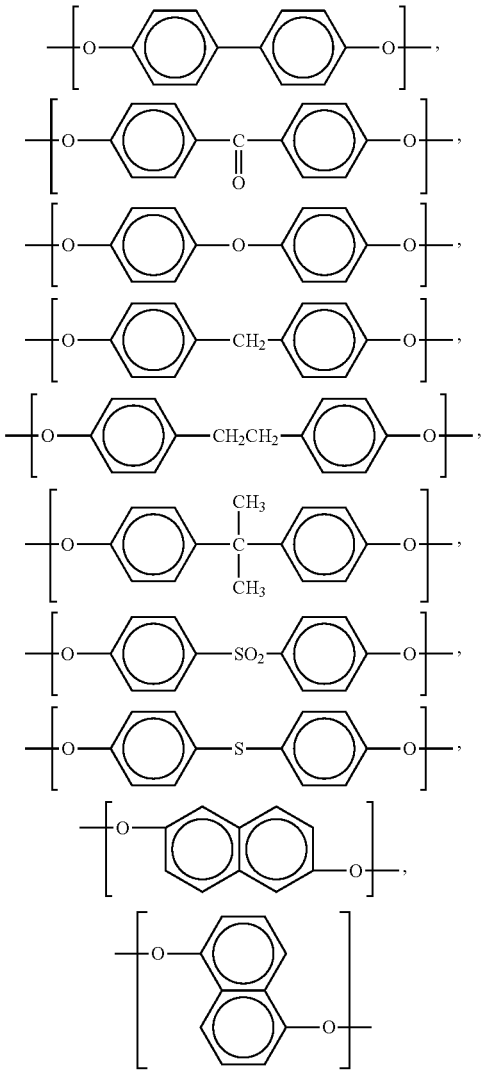

c. Repeating units derived from aromatic hydroxycarboxylic acids:

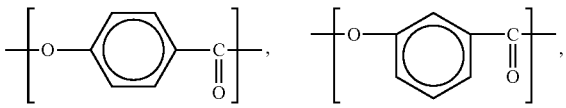

-continued

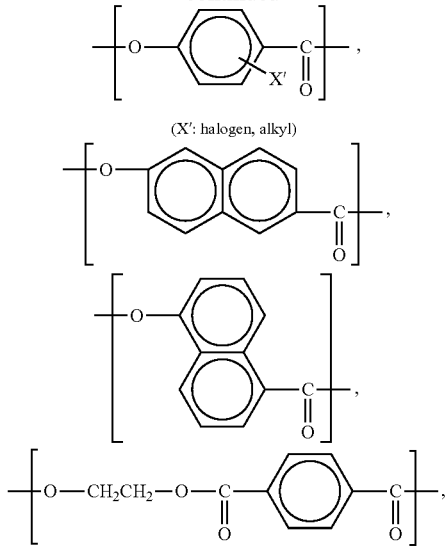

(X′: halogen, alkyl)

It is preferable from the standpoint of the balance among processability, heat resistance and mechanical properties in film-forming processes that the liquid crystal polymer contains the following repeating unit; more preferably contains the following repeating unit in an amount of at least 30 mole %, with respect to the total repeating units.

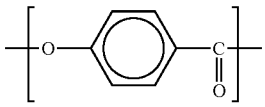

Preferable examples of the combination of repeating units constituting the liquid crystal polymer include the combinations (I) to (IV) described below.

(I)

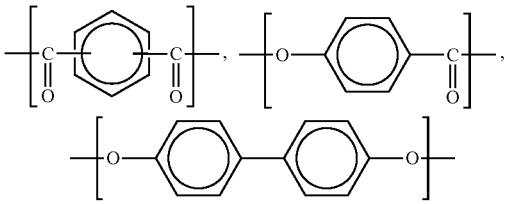

(II)

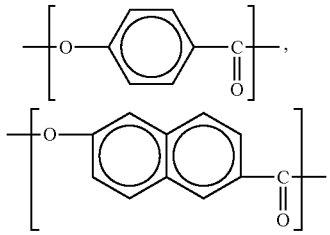

(III)

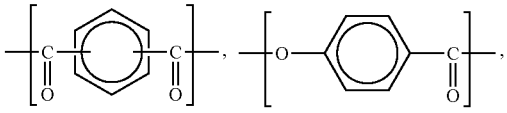

-continued

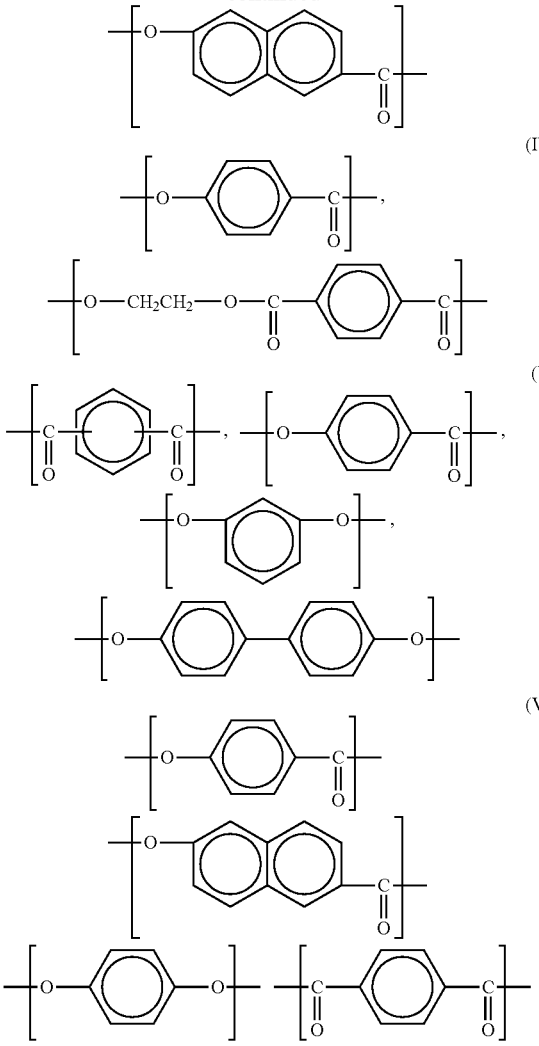

(IV)

(V)

(VI)

Methods for preparing such polyester-based resin of the liquid-crystal polymers are disclosed in, for example, JP-A-2-51523, JP-B-63-3888 ("JP-B" means examined Japanese patent publication), JP-B-63-3891 and the like.

Among them, the combinations shown in (I), (II) and (V) are preferable, and the combination shown in (V) is more preferable.

The melting point of the polyester-based resin of the liquid crystal polymer is slightly higher than that of the polyamide resin or the thermoplastic polyester used in the present invention and the flow temperature is 300° C. or more. Since the melt viscosity at melting of the polyester-based resin of the liquid crystal polymer is equal to or lower than those of polyethylene terephthalate and nylon 6,6, the layer can be extrusion-coated at high speed and can be formed at low cost.

The liquid crystal polymer film is characteristic in that the elongation thereof is as extremely low as a few percent, and it has a problem in terms of flexibility. For this reason, the liquid crystal polymer is blended with a polyester-based resin other than a liquid crystal such as polybutylene terephthalate, polyethylene terephthalate or polyethylene naphthalate so as to improve the elongation of the film, thus improving the flexibility of the film.

As the resin to form the inner layer (B) of the present invention, it is preferable to use a resin containing a resin mixture which includes an epoxy group-containing resin in the base resin component containing polyester-based resins of the liquid crystal polymer and a polymer other than a liquid crystal, wherein the polyester-based resin is used as a continuous layer and the epoxy group-containing resin is a dispersed phase. The content of the epoxy group-containing resin is preferably 1 to 20 parts by mass, more preferably 2 to 15 parts by mass based on 100 parts by mass of a base resin component of the polyester-based resin.

If the content of the epoxy group-containing resin exceeds 20 parts by mass, the heat resistance is slightly reduced. This is presumed because the heat resistance of the component of the epoxy group-containing resin is low as compared with the liquid crystal polymer (LCP) or PET.

Typical examples of the epoxy group-containing resins may include an ethylene/glycidylmethacrylate copolymer, an ethylene/glycidylmethacrylate/methylacrylate terpolymer, an ethylene/glycidylmethacrylate/vinylacetate terpolymer, an ethylene/glycidylmethacrylate/methylacrylate/vinylacetate tetrapolymer, and the like. Among them, the ethylene/glycidylmethacrylate copolymer and the ethylene/glycidylmethacrylate/methylacrylate terpolymer are preferred. Examples of commercially available resin may include Bondfast (trade name, manufactured by Sumitomo Chemical Co., Ltd.) and LOTADER (trade name, manufactured by ATOFINA Chemicals, Inc.).

In another embodiment, a resin containing the polyphenylene sulfide resin of a crystalline resin having a melting point 225° C. or more is preferred as a resin constituting the inner layer (B). In the present invention, from the viewpoint of obtaining good extrusion performance as a coating layer of the multilayer insulated electric wire, the polyphenylene sulfide resin having a low degree of cross-linking is preferred. However, unless resin properties are impaired, a cross-linkable polyphenylene sulfide resin may be used in combination, or a cross-linking component, a branching component, or the like may be incorporated into a polymer.

The polyphenylene sulfide resin having a low degree of cross-linking has an initial value of tanσ (loss modulus/storage modulus) of preferably 1.5 or more, or most preferably 2 or more in nitrogen, at 1 rad/s, and at 300° C. There is no particular upper limit on the value of tanσ. The value of tanσ is generally 400 or less, but may be larger than 400. The value of tanσ, in the present invention, may be easily evaluated from time dependence measurement of a loss modulus and a storage modulus in nitrogen, at the above constant frequency, and at the above constant temperature. In particular, the value of tanσ may be calculated from an initial loss modulus and an initial storage modulus immediately after the start of the measurement. A sample having a diameter of 24 mm and a thickness of 1 mm may be used for the measurement. An example of a device capable of performing such measurement includes an Advanced Rheometric Expansion System (trade name, abbreviated as ARES) manufactured by TA Instruments Japan. The above value of tanσ may serve as an indication of a level of cross-linking. A polyphenylene sulfide resin having a less than 2 of tanσ hardly provides sufficient flexibility and hardly provides a good appearance.

Examples of the resin constituting the inner layer (B) of another embodiment include resins which contain a polyether sulfone resin of an amorphous resin having a glass transition temperature of 200° C. or more. Examples of polyethersulfone resin for use in this invention include the compounds represented in the following formula (2):

Formula (2)

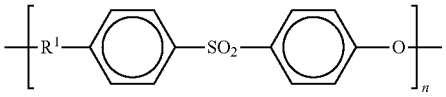

wherein $R^1$ represents a single bond or —$R^2$—O—, in which $R^2$ represents a phenylene group, a biphenylene group, or a group represented by the following formula,

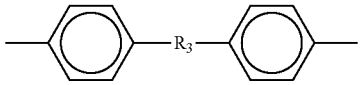

in which $R_3$ represents an alkylene group such as —C$(CH_3)_2$– or —$CH_2$–; and the group represented by $R^2$ may further have a substituent; and n represents a positive integer.

These resins may be produced by usual methods. For example, a manufacturing method in which a dichlorodiphenyl sulfone, bisphenol S, and potassium carbonate are reacted in a high-boiling solvent, can be mentioned. As commercially available resins, for example, VICTREX PES SUMIKAEXCEL PES (trade names, manufactured by Sumitomo Chemical Co., Ltd.), RADEL A RADEL R (trade names manufactured by Amoco), and the like can be mentioned.

Figure 3:
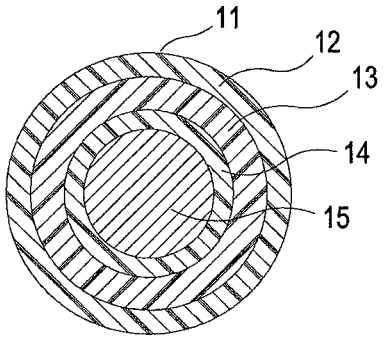
FIG. 3 is a cross-sectional view of a multilayer insulated electric wire composed of three insulating layers.

A preferred example of the multilayer insulated electric wire of the present invention will be described with reference to the drawings. As shown in FIG. 3, a multilayer insulated electric wire 11 having a three-layered structure of an outermost layer 12, the inner layer (B1) 13 which is in contact with the outermost layer, and the inner layer (B2) 14 inside thereof can be formed. In FIG. 3, the multilayer insulated electric wire composed of three layers is illustrated, however, the insulating layer may be three or more layers.

In the inner layer (B) of two or more layers located at the inner inside of the outermost layer (A) of the multilayer insulated electric wire of the present invention, it is preferable that resins for forming each of the layers are the same. However, the resins may be different. When the resins are different, each of the layers is formed using a combination of different resin mixtures described in the above-described embodiment or a combination of the resin mixture and resin composition.

The inner layer (B1) which is in contact with the outermost layer (A) is preferably a polyphenylene sulfide resin of a crystalline resin having a melting point of 250° C. or more. As the resin, the polyphenylene sulfide resin which is excellent in extrusion processability and has a low degree of cross-linking is preferred. The resin to form the inner layer (B2) at the inner inside of the inner layer (B1) is preferably a resin mixture prepared by mixing 1 to 20 parts by mass of the epoxy group-containing resin based on 100 parts by mass of the thermoplastic linear polyester resin which is the crystalline resin having a melting point of 225° C. or more. The thermoplastic linear polyester resin similar to that of the embodiment can be used.

Other heat resistant resins, usually-used additives, inorganic fillers, processing aids, colorants or the like may be added to the resin constituting each insulating layer in the present invention in a range without impairing the desired characteristics.

As the conductor to be used for the multilayer insulated electric wire of the present invention, a metal bare wire (singlet), an insulated electric wire obtained by forming an enameled layer or a thin-walled insulating layer on a metal bare wire, or a multi-stranded wire obtained by twisting a plurality of metal bare wires or a plurality of an enamel-insulated electric wires or thin-walled insulated electric wires may be used. The number of stranded wires in the wire may be optionally selected depending on the high-frequency application. When the number of wires of a core wire (element wire) is large (for example, a 19- or 37-element wire), the core wire may be in a form of a non-stranded wire. In the case of the non-stranded wire, for example, a plurality of electric wires may be gathered together to bundle up them in an approximately parallel direction, or the bundle of them may be intertwined in a very large pitch. In each case, it is preferable that the cross section thereof has almost a circular shape.

The multilayer insulated electric wire of the present invention is produced by sequentially extruding the insulating layers in such a manner that a first insulating layer having a desired thickness is extrusion-coated on the outer periphery of a conductor in an ordinary manner, a second insulating layer having a desired thickness is extrusion-coated on the outer periphery of the first insulating layer, and an outermost insulating layer. The whole thickness of the extruded layers formed in this manner is preferably set to within a range of 50 to 180 μm in the case of three layers. This is because when the whole thickness of the insulating layers is too thin, electric characteristics of the obtained multilayer insulated electric wire having heat resistance are largely reduced and may be unsuitable for practical use. To the contrary, when the thickness is too thick, it is unsuitable for miniaturization and coil processing may become difficult. More preferably, the range is 60 to 150 μm. The thickness of the outermost layer is set to preferably 25 μm or less, more preferably from 10 to 20 μm when the polyamide resin is used for the outermost layer as described above.

As the embodiment of the transformer using the above-described multilayer insulated electric wire, a structure in which the primary winding 4 and the secondary winding 6 are formed without incorporating the insulating barrier and the insulating tape layer in the bobbin 2 on the ferrite core 1, as shown in FIG. 1, is preferred. The multilayer insulated electric wire of the present invention may be applied to other types of transformers.

EXAMPLES

The present invention will be described in more detail based on examples given below, but the invention is not meant to be limited by these.

Examples 1 to 11 and Comparative Examples 1 to 6

As conductors, annealed copper wires having a diameter of 1.0 mm were provided. Each multilayer insulated wire was manufactured by sequential extrusion coating on the conductor with the extrusion coating resin composition and the thickness of each layer shown in Table 1 (in which the composition data are parts by mass). In Table 1, "–" indicates no addition of the resin component.

Abbreviations indicating the resins in Table 1 are as follows. The melting point or glass transition temperature of each resin was measured using a Differential Scanning calorimetry (trade name: DSC-60, manufactured by Shimadzu Corporation).

Poly amide resin: "FDK-1"
(trade name, manufactured by UNITIKA LTD.),
Polyamide 66 resin (melting point: 260° C.)
PPS resin: "FZ-2200-A8"
(trade name, manufactured by DIC Corporation),
Polyphenylene sulfideresin (melting point: 280° C.)
PET resin: "Teijin PET"
(trade name, manufactured by Teijin Ltd.),
Polyethylene terephthalate resin (melting point: 260° C.)
LCP resin: "Rodrun LC5000"
(trade name, manufactured by UNITIKA LTD.),
Liquid crystal polyester resin (melting point: 280° C.)
Epoxy group-containing resin: "Bondfast 7M"
(trade name, manufactured by Sumitomo Chemical Co., Ltd.),
(melting point: 52° C.)
Ethylene-based copolymer: "HIMILAN 1855"
(trade name, manufactured by DU PONT-MITSUI POLY-CHEMICALS),
(melting point: 86° C.)
PES resin: "SUMIKAEXCEL PES4100"
(trade name, manufactured by Sumitomo Chemical Co., Ltd.),
Polyethersulfone resin (glass transition temperature: 225° C.)

As for each of the obtained multilayer insulated electric wires, various kinds of characteristics were examined by the following methods. The external appearance was observed with the bare eye. The obtained results are shown in Table 1.

A. Flexibility:

An electric wire was closely wound 10 times around itself and observed with a microscope. When cracks or crazes did not appear on the film, it was judged as "passed" and designated as "○".

B. Electric heat resistance:

The heat resistance was evaluated by the following test method, in conformity to 61558-standards of the IEC standards.

Ten turns of the multilayer insulated electric wires were wound around a mandrel with a diameter of 10 mm under a load of 9.4 kg. They were heated for 1 hour at 225° C., and then three cycles of heating the electric wires at 150° C. for 21 hours and heating them at 200° C. for 3 hours were performed, and then they were kept in an atmosphere of 30° C. and humidity 95% for 48 hours. Thereafter, a voltage of 5,500 V was applied thereto for 1 minute. When there was no electrical short-circuit, it was considered that it passed Class B and designated as "○". (The judgment was made with n=5. It was considered that it did not pass the test even when one is judged as NG and designated as "x".)

C. Solvent resistance:

The electric wire subjected to 20D (20 times of the diameter of the conductor) winding as winding processing was dipped in a solvent of xylene and isopropyl alcohol for 30 seconds and dried. Then, the surface of the sample was observed to judge whether crazing occurred or not. In Table 1, a sample showing no crazing was designated as "○", while a sample showing crazing was designated as "x". No crazing was observed in all the samples.

D. Passing status:

It was determined whether each sample was passed or failed as an insulated electric wire based on the total of the test results of A, B, and C. A preferable sample was designated as "○" and an unsuitable sample was designated as "x".

TABLE 1

| | | | Ex. 1 | Ex. 2 | Ex. 3 | Ex. 4 | Ex. 5 | Ex. 6 | Ex. 7 | Ex. 8 | Ex. 9 | Ex. 10 | Ex. 11 | CE. 1 | CE. 2 | CE. 3 | CE. 4 | CE. 5 | CE. 6 |
|---|---|---|---|---|---|---|---|---|---|---|---|---|---|---|---|---|---|---|---|
| First layer (Outermost layer: A) | Resin (A) | Polyamide resin | 100 | 100 | 100 | 100 | 100 | 100 | 100 | 100 | 100 | 100 | 100 | 100 | 100 | 100 | 100 | — | — |
| | | PPS resin | — | — | — | — | — | — | — | — | — | — | — | — | — | — | — | — | — |
| | | PET resin | — | — | — | — | — | — | — | — | — | — | — | — | — | — | — | 85 | 85 |
| | | LCP resin | — | — | — | — | — | — | — | — | — | — | — | — | — | — | — | — | — |
| | | Epoxy group-containing resin | — | — | — | — | — | — | — | — | — | — | — | — | — | — | — | 15 | 15 |
| | Thickness [μm] | | 20 | 20 | 20 | 20 | 20 | 20 | 20 | 20 | 20 | 20 | 20 | 30 | 30 | 30 | 30 | 20 | 30 |
| Second layer (Layer between Outermost layer and Intermost layer: B1) | Resin (B) | PET resin | 100 | 100 | 100 | 85 | 86 | 89 | — | — | — | — | — | 100 | 85 | — | — | 100 | 100 |
| | | LCP resin | — | — | — | 15 | 14 | 11 | — | — | — | — | — | — | 15 | — | — | — | — |
| | | Epoxy group-containing resin | — | 11 | — | — | 5 | — | — | — | — | — | — | — | — | — | — | 18 | 18 |
| | | Ethylene-based copolymer | — | — | 18 | — | — | 11 | — | — | — | — | — | — | — | — | — | — | — |
| | | PPS resin | — | — | — | — | — | — | 100 | — | 100 | 100 | — | — | — | 100 | — | — | — |
| | | PES resin | — | — | — | — | — | — | — | 100 | — | — | 100 | — | — | — | 100 | — | — |
| | Thickness [μm] | | 40 | 40 | 40 | 40 | 40 | 40 | 40 | 40 | 40 | 40 | 40 | 35 | 35 | 35 | 35 | 40 | 35 |
| Third layer (Innermost layer: B2) | Resin (C) | PET resin | 100 | 100 | 100 | 85 | 86 | 89 | — | — | 100 | 100 | 100 | 100 | 85 | 100 | 100 | 100 | 100 |
| | | LCP resin | — | — | — | 15 | 14 | 11 | — | — | — | — | — | — | 15 | — | — | — | — |
| | | Epoxy group-containing resin | — | 11 | 18 | — | 5 | — | — | — | — | 9 | 11 | — | — | 11 | 11 | 18 | 18 |
| | | Ethylene-based copolymer | — | — | — | — | — | 11 | — | — | — | — | — | — | — | — | — | — | — |
| | | PPS resin | — | — | — | — | — | — | 100 | — | — | — | — | — | — | — | — | — | — |
| | | PES resin | — | — | — | — | — | — | — | 100 | — | — | — | — | — | — | — | — | — |
| | Thickness [μm] | | 40 | 40 | 40 | 40 | 40 | 40 | 40 | 40 | 40 | 40 | 40 | 35 | 35 | 35 | 35 | 40 | 35 |
| Total thickness [μm] | | | 100 | 100 | 100 | 100 | 100 | 100 | 100 | 100 | 100 | 100 | 100 | 100 | 100 | 100 | 100 | 100 | 100 |
| Flexibility | | | ○ | ○ | ○ | ○ | ○ | ○ | ○ | ○ | ○ | ○ | ○ | ○ | ○ | ○ | ○ | ○ | ○ |
| Electric heat resistance | [Class B] | | ○ | ○ | ○ | ○ | ○ | ○ | ○ | ○ | ○ | ○ | ○ | x | x | x | x | x | x |
| Solvent resistance | Xylene | | ○ | ○ | ○ | ○ | ○ | ○ | ○ | ○ | ○ | ○ | ○ | ○ | ○ | ○ | ○ | ○ | ○ |
| | Isopropyl alcohol | | ○ | ○ | ○ | ○ | ○ | ○ | ○ | ○ | ○ | ○ | ○ | ○ | ○ | ○ | ○ | ○ | ○ |
| Passing status | | | ○ | ○ | ○ | ○ | ○ | ○ | ○ | ○ | ○ | ○ | ○ | x | x | x | x | x | x |

The results shown in Table 1 revealed the following.

In Comparative examples 1 to 4, the film thickness of the polyamide resin (the outermost layer) became 30 μm and the electric heat resistance was not satisfied. In Comparative examples 5 and 6, if the polyester resin was used for the outermost layer, the electric heat resistance was not satisfied regardless of the film thickness. On the other hand, in Examples 1 to 11, all of the flexibility, electric heat resistance, chemical resistance, and wire appearance satisfied the acceptance criterion.

Industrial Applicability

According to the multilayer insulated electric wire of the present invention, there is provided a multilayer insulated electric wire which satisfies the heat resistance and the requirement of voltage resistance characteristics and has good processability after soldering which is required in coil applications.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority on Patent Application No. 2009-203148 filed in Japan on Sep. 2, 2009, which is entirely herein incorporated by reference.

REFERENCE SIGNS LIST

1: Ferrite core
2: Bobbin
3: Insulating barrier
4: Primary winding
4*a*: Conductor
4*b*, 4*c*, 4*d*: Insulating layers
5: Insulating tape
6: Secondary winding
6*a*: Conductor
6*b*, 6*c*, 6*d*: Insulating layers

The invention claimed is:

1. A multilayer insulated electric wire comprising:

a conductor; and three extruded insulating layers covering the conductor, which insulating layers comprise an outermost layer (A) and inner layers (B);

wherein the outermost layer (A) is composed of an extruded coating layer containing a resin, said resin consisting of a polyamide resin and a thickness of the layer is 25μm or less, wherein base resin components to form the inner layers (B) each are comprised of 75 to 95% by mass of a polyester-based resin of the crystalline resin having a melting point 225° C. or more, except a liquid crystal polymer, and 5 to 25% by mass of a polyester-based resin of a liquid crystal polymer having a melting point of 225° C. or more.

2. The multilayer insulated electric wire according to claim 1, wherein resins for forming the inner layers (B) each contain 1 to 20 parts by mass of an epoxy group-containing resin based on 100 parts by mass of the base resin component.

3. A transformer, comprising the multilayer insulated electric wire according to claim 1.

4. The multilayer insulated electric wire according to claim 1, wherein the thickness of the outermost layer is 10 to 20μm.

* * * * *